US006322331B1

(12) United States Patent
Swatek et al.

(10) Patent No.: US 6,322,331 B1
(45) Date of Patent: Nov. 27, 2001

(54) TUBULAR JUNCTION FOR TUBING PUMP

(75) Inventors: Mike Allen Swatek, Claremore, OK (US); Kent H. Cozzens, Ventura, CA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/437,825

(22) Filed: Nov. 10, 1999

Related U.S. Application Data

(60) Provisional application No. 60/107,919, filed on Nov. 10, 1998.

(51) Int. Cl.[7] ..... F04B 17/00; E21B 4/04; E21B 43/00; E21B 23/00; E21B 19/00

(52) U.S. Cl. ..... 417/360; 417/359; 417/424.2; 166/66.4; 166/105; 166/381; 166/378

(58) Field of Search ..... 417/359, 360, 417/424.2, 423.15; 166/66.4, 105, 381, 378, 106, 117.5, 117.6

(56) References Cited

U.S. PATENT DOCUMENTS

| | | | | |
|---|---|---|---|---|
| Re. 35,454 | | 2/1997 | Cobb | 166/265 |
| 1,896,110 | | 2/1933 | Simmons . | |
| 4,452,305 | * | 6/1984 | Schwendemann | 166/117.5 |
| 4,898,244 | | 2/1990 | Schneider | 166/297 |
| 5,224,545 | * | 7/1993 | George et al. | 166/297 |
| 5,284,210 | * | 2/1994 | Helms et al. | 166/385 |
| 5,706,896 | * | 1/1998 | Tubel et al. | 166/313 |
| 5,732,773 | * | 3/1998 | Parks et al. | 166/117.5 |
| 5,746,582 | | 5/1998 | Patterson | 417/53 |
| 5,871,051 | | 2/1999 | Mann | 166/105 |
| 5,954,483 | | 9/1999 | Tetzlaff . | |

FOREIGN PATENT DOCUMENTS 2325483A 11/1998 (GB) .

OTHER PUBLICATIONS

Pump Bypass Tool; 1992; Centrilift; Baker Hughes Incorporated.

* cited by examiner

*Primary Examiner*—Timothy S. Thorpe
*Assistant Examiner*—Timothy P. Solak
(74) *Attorney, Agent, or Firm*—Bracewell & Patterson, L.L.P.

(57) ABSTRACT

A well pump assembly has a tubular junction having a main tube and a bypass tube. An electric motor and seal section hang below the tubular junction in the main tube. The motor is powered by a power cable that extends alongside the tubing to the surface. The motor has an upper end with a drive shaft coupling. The pump for the motor is lowered through the production tubing on a wireline, wire rope or coiled tubing. The pump has a lower end which has a driven shaft coupling that makes up in stabbing engagement with the drive shaft coupling when the pump reaches the motor. The driven shaft coupling includes a guide that slides into a coupling housing. Orientating keys orient the guide and lock it from rotation. The bypass tube of the tubular junction may receive workover tools that are diverted by a wireline tool.

25 Claims, 2 Drawing Sheets

TUBULAR JUNCTION FOR TUBING PUMP

CROSS-REFERENCE

This application claims the benefit of provisional application Ser. No. 60/107,919 filed Nov. 10, 1998.

TECHNICAL FIELD

This invention relates in general to a hydrocarbon production well, and in particular to a well utilizing a centrifugal pump operated by a submersible electric motor, wherein the pump is retrievable through a main tube of a tubular junction. Wire line tools may be inserted through a bypass tube of the tubular junction.

BACKGROUND ART

Electrical submersible well pumps for deep wells are normally installed within casing on a string of tubing. Usually the tubing is made up of sections of pipe screwed together. Coil tubing deployed from a reel may also be used. The motor is supplied with power through a power cable that is strapped alongside the tubing. The pump is typically located above the motor, is connected to the lower end of the tubing, and pumps fluid through the tubing to the surface. One type of a pump is a centrifugal pump using a plurality of stages, each stage having an impeller and a diffuser. Another type of pump, for lesser volumes, is a progressing cavity pump. A progressing cavity pump utilizes a helical rotor that is rotated inside an elastomeric stator that has double helical cavities. The stator is located inside a metal housing.

Periodically, the pump assembly must be pulled to the surface for repair or replacement. This involves pulling the tubing, which is time consuming. A workover rig is necessary for production tubing, and a coiled tubing unit is needed to pull coiled tubing. Often, the electrical motor needs no service, rather the service needs to be performed only on the pump. Sometimes the only change needed is to change the size of the pump without changing the size of the motor. However, the motor, being attached to the lower end of the pump, is also pulled along with the tubing. Damage to the power cable is not uncommon when pulling the tubing.

Also periodically, well workovers must be performed. In some prior art wells, wire line tools are routed through a main tube of a Y-tool, while the pump assembly is positioned in the bypass tube of the Y-tool. However, in these wells, the motor and pump must be pulled together, thereby subjecting the power cable to damage.

Therefore, a pump assembly is needed that permits a pump to be retrieved without pulling the motor, yet allows workover tools to be used for well workovers.

SUMMARY OF INVENTION

In this invention, the motor is secured to the lower end of the tubing. A power cable to the motor is strapped alongside the tubing. The centrifugal pump, however, is sized to be lowered through the tubing. The pump has a driven shaft extending downward from it that mates with a drive shaft extending upward from the motor. When the pump reaches the motor, the driven shaft will stab into the drive shaft.

A special Y-tool or tubular junction is provided having a main leg and an offset leg. The seal section and motor are secured to the main leg, thereby allowing the offset leg of the tubular junction to be used for wireline operations. The tubular junction supports or incorporates an eye and locking apparatus that mates with the bottom of the through tubing conveyed (TTC) pump or intake. The tubular junction incorporates intake passages in the main leg that allow well fluid to access the pump intake.

The bypass tube is used for well workovers or other operations which do not require pulling the tubing. It will be necessary to first remove the pump with a quick and inexpensive method such as wireline. After removal of the pump, a wireline-deployed tool may be necessary to divert the workover tools into the bypass tube, because the bypass tube is offset from the production tubing or liner. This wireline tool will have a means of retaining the tool as it lands in position so that the workover tool goes in the correct direction.

The upper end of the pump is designed for engagement by a running and retrieving tool. The running and retrieving tool is used to lower the pump through the tubing and retrieve it. The pump may be secured to wireline, wire rope or coiled tubing which inserts through the production tubing. The pump pumps well fluid up through the tubing.

When it is desirable to change out or repair the pump, the operator lowers a running tool through the production tubing and latches it to the pump. The operator pulls the pump, leaving the motor in place. Subsequently, the running tool lowers the repaired or replacement pump back through the tubing into engagement with the motor.

The electric motor assembly is mounted to a coupling housing which is secured to the lower end of the tubing. The coupling housing has an anti-rotation key within its bore. The drive shaft of the electric motor assembly extends into the coupling housing. The lower end of the pump assembly driven shaft is located within a tubular guide. The guide extends slidingly into the coupling housing as the pump assembly is being lowered. The guide rotatably receives the lower portion of the drive shaft. The guide has an engagement member on its exterior which engages the internal anti-rotation member in the bore of the coupling housing.

BEST MODE FOR CARRYING OUT THE INVENTION

Figure 1:
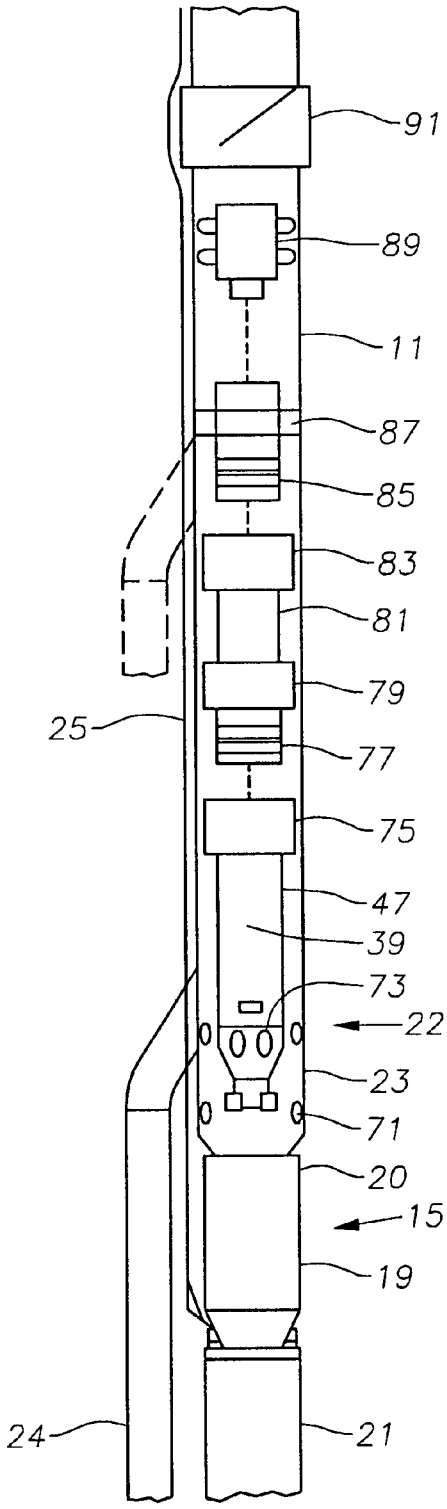
FIG. 1 is a partially exploded schematic view of a pump system in accordance with this invention.
Figure 2:
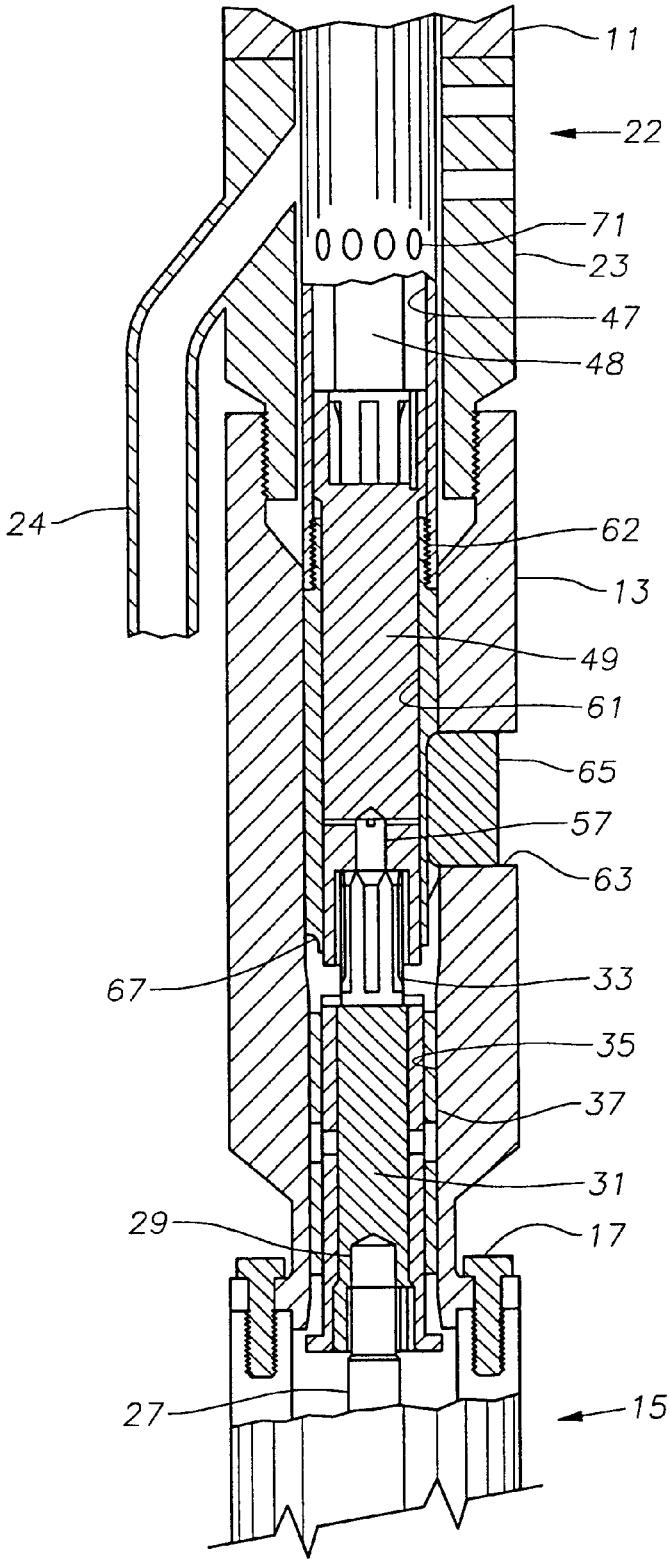
FIG. 2 is an enlarged sectional view, of the tubular junction and area surrounding the pump/motor interface of the invention of FIG. 1.
Figure 3:
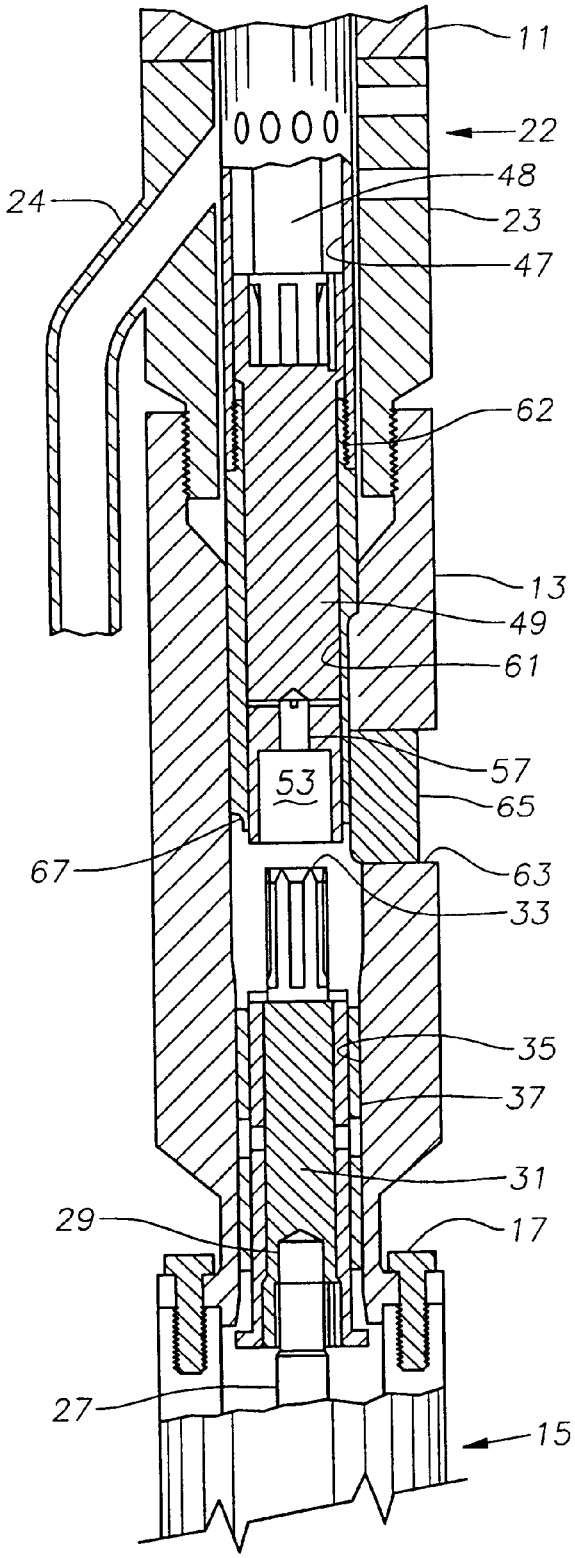
FIG. 3 is an enlarged sectional view, of the tubular junction and area surrounding the pump/motor interface of the invention of FIG. 1, wherein the pump and motor are disengaged.

Referring to FIGS. 1, 2, and 3, a string of production tubing 11 extends from the surface into a cased well (not shown). Production tubing 11 is a conduit made up of sections of pipe, for example four inches in diameter, screwed together. Alternatively, production tubing 11 may be coiled tubing. A coupling housing 13 is located at and forms the lower end of tubing 11. Coupling housing 13 is a tubular member with approximately the same diameter as tubing 11 and is preferably connected to the tubing by threads.

An electric motor assembly 15 is secured to coupling housing 13 by bolts 17. Motor assembly 15 includes a seal section 19, and optionally a gear reducer 20, which is mounted to an A.C. electric motor 21 (FIG. 1). Seal section 19 equalizes hydrostatic pressure with pressure of lubrication in the motor and seals around the drive shaft extending from the motor 21. Seal section 19 is of a conventional design.

Tubular junction, such as Y-tool 22 has a main tube 23 and a bypass tube 24. Bypass tube 24 joins main tube 23 above seal section 19. A three-phase power cable 25 connects to motor 21 and extends alongside tubing 11 to the surface for delivering power. Motor 21 typically operates at about 3600 rpm, which is reduced by gear reducer 20 to a lower speed if a gear reducer is employed. Seal section 19 seals well fluid from the interior of motor 21 and also equalizes pressure differential between lubricant in motor 21 and the exterior.

As shown in FIGS. 2 and 3, a drive shaft 27 extends upward from and is driven by motor 21. Drive shaft 27 extends through seal section 19 and has a splined end 29 which mates with a drive shaft coupling 31. Drive shaft coupling 31 is a short shaft that forms the upper end of drive shaft 27. Drive shaft coupling 31 has a splined upper end 33 and is carried within bore 35 of coupling housing 13. Drive shaft coupling 31 is rotatably supported within bore 35 by bushings 37.

Referring again to FIG. 1, a pump 39 is driven by motor 21. Pump 39 may be a progressing cavity pump, or a centrifugal pump. A progressing cavity pump has a metal rotor which has an exterior helical configuration. The rotor orbitally rotates within an elastomeric stator. The stator has double helical cavities located along its axis through which the rotor rotates. Gear reducer 20 is used if pump 39 is a progressive cavity pump.

Figure 4:
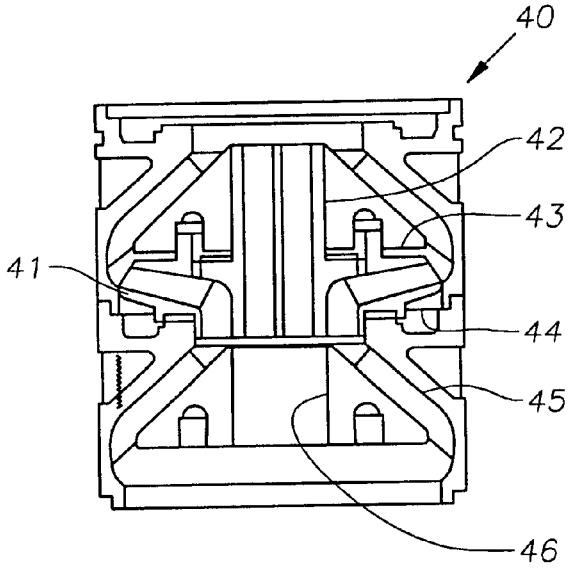
FIG. 4 is a sectional view of a stage of a centrifugal pump used in one embodiment of the invention.

Pump 39 may also be a centrifugal pump having a plurality of stages 40 (FIG. 4). A conventional centrifugal pump stage 40 includes an impeller 41 having a hub 42, a top shroud 43, and a bottom shroud 44. Pump stage 40 additionally includes a diffuser 45 having a diffuser bore 46. If pump 39 is a centrifugal pump, a gear reducer 20 will not be used.

Tubular housing 47 is secured to a lower end of pump 39 and may be considered a part of pump 39. A metal shaft 48 is located within housing 47. If pump 39 is a progressing cavity pump, shaft 48 is flexible and orbits at its upper end and rotates in pure rotation at its lower end. Shaft 48 is connected on its upper end to pump 39 and may be considered a part of a driven shaft of pump 39.

Shaft 48 has a driven shaft coupling 49 on its lower end. Driven shaft coupling 49 may be secured to shaft 48 by a pin (not shown). Driven shaft coupling 49 is a solid cylindrical member which has a cavity on its lower end containing a sleeve or receptacle 53 (FIG. 3) having splines (not shown) therein. Receptacle 53 has an upward extending shank 57 to secure receptacle 53 within the cavity of drive shaft coupling 49 by means of a pin. Receptacle 53 mates slidingly with splined upper end 33 of drive shaft coupling 31.

A guide 61 surrounds driven shaft coupling 49. Guide 61 is a tubular member or sleeve having an outer diameter for close reception within bore 35 of coupling housing 13. Guide 61 has a bore through it which rotatably receives driven shaft coupling 49. Guide 61 has threads 62 on its upper end which secure guide 61 to shaft housing 47. Guide 61 also has three elongated slots 63 (only one shown) on its exterior spaced 120° apart. Slots 63 are sized to mate with three keys 65. Keys 65 are stationarily mounted to coupling housing 13 and protrude radially inward into bore 35. Keys 65 are also 120° apart from each other and serve to prevent rotation of guide 61 in coupling housing 13.

Guide 61 has a tapered nose 67 for orienting and mating slots 63 with keys 65 when pump 39 is lowered into engagement with motor assembly 15. Preferably, there are three tapered surfaces on nose 67. Each tapered surface extends upward and leads to one of the slots 63.

Referring again to FIG. 1, well fluid for pump 39 is drawn through perforations 71 in tubing 11 below pump 39 and through perforations 73 in tubular housing 47. A packing sleeve 75 is positioned on an upper end of pump 39, sealing the housing of pump 39 to the interior of tubing 11. Packing sleeve 75 preferably has a GS fishing neck and packing bore thereon. V-type packing 77 is positioned within packing sleeve 75. Packing 77 isolates the intake of pump 39 from its discharge. A check valve 79 is positioned above V-type packing 77. A tubing joint or sand tube 81 is provided to collect sand in the well bore. V-type packing 77 seals off sand tube 81 to discharge from pump 39. A second packing sleeve 83 is positioned above sand tube 81. Second packing sleeve 83 preferably has a GS fishing neck and packing bore therein. Second V-type packing 85 is positioned above packing sleeve 83 to seal off sand tube 81. Tubing packoff 87 is provided proximate V-type packing 85. Tubing packoff 87 preferably has a GS fishing neck and a rubber element. Tubing stop 89 is frictionally fit into the top of tubing packoff 87. Tubing stop 89 has slips to stop any upward movement of pump 39. A full open flapper valve or retrievable flapper valve assembly 91 may be provided instead of a surface lubricator.

In operation, during initial installation, the operator will connect motor assembly 15 together including gear reducer 20 and seal section 19. The operator connects motor assembly 15 to coupling housing 13, and connects coupling housing 13 to the lower end of a string of tubing 11. The operator then lowers the string of tubing 11 into the well to its desired depth. Power cable 25 is strapped alongside tubing 11 as tubing 11 is lowered into the well.

The operator then makes up the pump assembly including pump 39, tubular housing 47, packing sleeve 75, v-type packing 77, check valve 79, tubing joint 81, packing sleeve 83, v-type packing 85, tubing packoff 87, tubing stop 89 and flapper valve 91 unless it was previously installed. The operator latches the pump assembly to a running tool (not shown). The running tool is fastened to a line, which may be wireline, wire rope or coiled tubing. The operator lowers the pump assembly through tubing 11. FIG. 3 shows guide 61 shortly before it stabs into engagement with drive shaft coupling 31. Tapered surfaces on tapered nose 67 of guide 61 will contact keys 65 and rotate guide 61 an amount necessary to orient slots 63 with keys 65. Receptacle 53 will slide over splined upper end 33, engaging pump 39 with motor 26.

The operator supplies power to power cable 25, which causes motor 21 to rotate, which in turn rotates shaft 48 and impellers 41 of a centrifugal pump or a rotor for a progressing cavity pump. Well fluid is drawn in through intake perforations 71 and 73. Well fluid pumps out of the upper end of pump 39 and flows upward through production tubing 11 to the surface.

When it is desired to change out pump 39 for repairs or otherwise, the operator lowers a running tool on a line back into engagement with the pump assembly. Pump 39 will move upward, bringing along with it shaft 48 and guide 61 as illustrated in FIG. 3. Motor 21 will remain in place as the operator pulls the pump assembly to the surface. The operator replaces or repairs the pump assembly and reinstalls it in the same manner as described. When it is necessary to run workover tools into the well bore or to perform other downhole operations, a wireline tool may be used to direct the tools into the bypass leg 24 of the tubular junction 22. Pump 39 must be removed to gain access to bypass leg 24. Then a kickover tool (not shown) will be landed next to the entrance of bypass leg 24. Wireline tools then may be lowered through tubing 11 and down bypass tube 24. The wireline tool can be lowered below tubular junction 22 into the casing.

The invention has significant advantages. By leaving motor 21 in place and retrieving only pump 39, the operation to change out pump 39 is much faster. In the case of production tubing, a workover rig need not be employed for pulling the tubing. Damage to power cable 25 is avoided as the production tubing will remain in place. Reducing the expense of changing out pump 39 reduces the cost of using a pump of this nature in the well. Guide 61 readily orients and stabs the lower end of pump 39 into engagement with drive shaft coupling 31. By positioning pump 39 in main tube 23 of tubular junction 22, rather than in bypass tube 24 of tubular junction 22, pump 39 may be disengaged from motor 21 for change-out or repair. A wireline tool may be used to divert workover tools into bypass tube 24 to enable wireline operations without pulling the tubing.

The use of the tubular junction is advantageous for use in 9⅝ inch casing with pull/run and/or lost production costs. The pump and intake, which are subject to wear due to the well fluid, can be inexpensively changed out as a preventative maintenance measure. Pumps can be frequently evaluated and repaired to avoid damage to the seal section and motor. The seal section can have a hardened bearing installed in the top end to extend its life after moderate pump radial wear. Additionally, the seal section, motor and cable will have a much longer useful life. Pull/run and lost production costs can also be greatly reduced.

While the invention has been shown in only one of its forms, it should be apparent to those skilled in the art that it is not so limited but is susceptible to various changes without departing from the scope of the invention. For example, although the junction is shown below the pump intake, it could be above the pump discharge. Further, the pump could be a progressing cavity type rather than a centrifugal type.

We claim:

1. A well pump assembly for mounting to a string of tubing extending into a well, comprising:

a tubular junction adapted to be connected to a lower end of the string of tubing, the tubular junction having a main tube and a bypass tube that branches off of the main tube from said junction;

a motor coaxial with the main tube of the tubular junction, the motor having a drive shaft;

a pump having a driven shaft that releasably couples to the drive shaft, the pump being capable of being lowered into and retrieved through the string of tubing; and wherein the bypass tube is capable of receiving tools lowered from the surface through the string of tubing.

2. The well pump assembly according to claim 1 wherein an upper end of the drive shaft of the motor is located below said tubular junction.

3. The well pump assembly according to claim 1 wherein said bypass tube receives said tools while said pump is removed from the string of tubing.

4. The well pump assembly according to claim 1 wherein the pump extends above the junction when the driven shaft is coupled to the drive shaft of the motor, thereby blocking access to the bypass tube.

5. The well pump assembly according to claim 1 wherein the main tube of the tubular junction is perforated to allow well fluids to flow to the pump.

6. The well pump assembly according to claim 1 wherein the pump is a centrifugal pump.

7. The well pump assembly according to claim 1 wherein the pump is a progressive cavity pump.

8. The well pump assembly according to claim 1 wherein the main tube of the tubular junction is adapted to be in axial alignment with the string of tubing.

9. The well pump assembly according to claim 1 further comprising:

a coupling housing on a lower end of the main tube of the tubular junction, the coupling housing having a bore therein;

a guide located on a lower end of the pump, surrounding a lower end of the driven shaft and releasably received within the bore of the coupling housing, the guide having at least one elongated slot on its exterior; and a key stationarily mounted to the coupling housing that protrudes radially inward into the bore and engages the elongated slot on the guide to prevent rotation of the guide within the bore of the coupling housing.

10. The well pump assembly according to claim 9 wherein the guide has a tapered nose to orient the slot with the key.

11. The well pump assembly according to claim 1 further comprising:

a coupling housing on a lower end of the main tube of the tubular junction, the coupling housing having a bore therein;

a guide located on a lower end of the pump, surrounding a lower end of the driven shaft and releasably received within the bore of the coupling housing, the guide having at least one elongated slot on its exterior;

a shaft coupling secured to a lower end of the driven shaft having a receptacle on a lower end for engaging an upper end of the drive shaft of the motor; and a key stationarily mounted to the coupling housing that protrudes radially inward into the bore and engages the elongated slot on the guide to prevent rotation of the guide within the bore of the coupling housing.

12. The well pump assembly according to claim 11 wherein the guide has a tapered nose to orient the slot with the key.

13. A well pump assembly, comprising in combination:

a string of tubing adapted to extend into a well;

a tubular junction connected to a lower end of the string of tubing, the tubular junction having a main tube that is coaxial with the string of tubing and a bypass tube that branches off of the main tube from the junction;

the main tube having a coupling housing located below the junction of the main tube and the bypass tube;

a motor mounted to the coupling housing, the motor having a drive shaft with an upper end that extends into the coupling housing;

a pump having a housing and a driven shaft with a lower end that releasably stabs into engagement with the upper end of the drive shaft, the pump having a lesser outer diameter than an inner diameter of the string of tubing and being capable of being lowered into and retrieved through the string of tubing while the motor remains mounted to the coupling housing;

an anti-rotation member in the main tube; and an anti-rotation member on the pump that engages the anti-rotation member in the main tube to prevent rotation of the housing of the pump;

the tubular junction being perforated to admit well fluid to the pump; and wherein the upper end of the drive shaft of the motor is located below the junction of the main tube and the bypass tube to enable tools to be lowered from the surface through the string of tubing.

14. The well pump assembly according to claim 13 wherein said tools are lowered from the surface through said bypass tube while the pump is removed from said string of tubing.

15. The well pump assembly according to claim 13 wherein the pump extends above the junction of the main tube and the bypass tube when the driven shaft is in engagement with the drive shaft of the motor.

16. The well pump assembly according to claim 13 wherein the pump is a centrifugal pump.

17. The well pump assembly according to claim 13 wherein the pump is a progressive cavity pump.

18. The well pump assembly according to claim 13 further comprising:

a guide located on a lower end of the pump, surrounding a lower end of the driven shaft and releasably received within the coupling housing;

wherein the anti-rotation member on the pump comprises at least one elongated slot on an exterior of the guide; and the anti-rotation member in the tubular junction comprises a key stationarily mounted to the coupling housing that protrudes radially inward into the coupling housing and engages the elongated slot on the guide to prevent rotation of the guide.

19. The well pump assembly according to claim 18 wherein the guide has a tapered nose to orient the slot with the key.

20. A method of installing and operating a submersible pump in a well and conducting an auxiliary operation in the well, comprising the steps of:

(a) mounting a pump motor that has a drive shaft coaxial to a main tube of a tubular junction, the tubular junction having a bypass tube joining the main tube at a junction;

(b) securing the tubular junction to a string of tubing with the main tube coaxial with the string of tubing, and lowering the string of tubing, tubular junction, and pump motor into the well; then (d) lowering a pump assembly through the string of tubing until a driven shaft of the pump assembly stabs into engagement with the drive shaft of the motor; then (e) providing power to the motor and rotating the pump assembly, thereby pumping well fluid through the string of tubing; then, to perform an auxiliary operation, (f) retrieving the pump through the string of tubing while leaving the motor mounted to the main tube; then (g) lowering a line through the string of tubing and through the bypass tube and performing the auxiliary operation with the line.

21. The method according to claim 20, wherein the step (g) further comprises:

placing a kickover tool at the junction of the main tube and the bypass tube; then directing the line into the bypass tube with the kickover tool.

22. The method according to claim 20, further comprising:

removing the line from the string of tubing; and lowering the pump assembly back through the string of tubing into operative engagement with the motor.

23. The method according to claim 20, wherein step (a) comprises positioning an upper end of the drive shaft below the junction of the main tube with the bypass tube.

24. The method according to claim 20, wherein step (d) further comprises preventing rotation of a housing of the pump assembly relative to the tubular junction.

25. The method according to claim 20, wherein step (e) comprises drawing the well fluid through perforations provided in the tubular junction.

* * * * *